United States Patent [19]

Kleinholz

[11] Patent Number: 4,867,366

[45] Date of Patent: Sep. 19, 1989

[54] PNEUMATIC FASTENER-DRIVING TOOL AND METHOD

[76] Inventor: Edward O. Kleinholz, 1518 E. Cross St., Tulare, Calif. 93274

[21] Appl. No.: 821,870

[22] Filed: Jan. 23, 1986

Related U.S. Application Data

[63] Continuation-in-part of Ser. No. 664,944, Oct. 26, 1984, Pat. No. 4,566,619, which is a continuation of Ser. No. 171,720, Jul. 24, 1980, abandoned, which is a continuation-in-part of Ser. No. 84,367, Oct. 12, 1979, abandoned, which is a continuation of Ser. No. 899,514, Apr. 24, 1978, abandoned.

[51] Int. Cl.[4] ..... B25C 1/04; B25C 1/18

[52] U.S. Cl. ..... 227/66; 173/139; 227/130; 227/156

[58] Field of Search ..... 29/432.1, 432.2; 173/139; 206/347, 345; 227/8, 66, 93, 94, 95, 114, 115, 116, 117, 130, 135, 120, 136, 156

[56] References Cited

U.S. PATENT DOCUMENTS

| | | | |
|---|---|---|---|
| 3,027,560 | 4/1962 | Nelson | 227/66 |
| 3,040,327 | 6/1962 | Michel | 227/66 |
| 3,438,449 | 4/1969 | Smith | 173/139 X |
| 3,622,062 | 11/1971 | Goode, Jr. et al. | 227/136 X |
| 3,774,293 | 11/1973 | Golsch | 227/66 X |

*Primary Examiner*—Paul A. Bell
*Attorney, Agent, or Firm*—Edward R. Weber

[57] ABSTRACT

A pneumatically operated fastener-driving tool, particularly adapted for nailing drywall to the framing of a building, comprising a housing, a reciprocator assembly mounted within the housing, and a piston mechanism mounted within the reciprocator assembly for axially driving the fastener into the drywall and underlying framing member. Upon actuation of the tool, the piston is pneumatically driven through a fastener-driving stroke and the reciprocator is reactively driven in an opposite direction. The oppositely driven reciprocator assembly absorbs recoil energy during the piston's driving stroke without transmitting an appreciable amount thereof to the housing, thereby substantially precluding housing recoil during driving of the fastener. At the end of the driving stroke, the reciprocator engages and is decelerated by the piston, thereby reducing housing recoil subsequent to the driving of the fastener. At the end of its driving stroke, the piston mechanism recesses the fastener in the drywall and engages a dimpler member to form a shallow recess around the driven fastener.

22 Claims, 7 Drawing Sheets

FIG. 18.
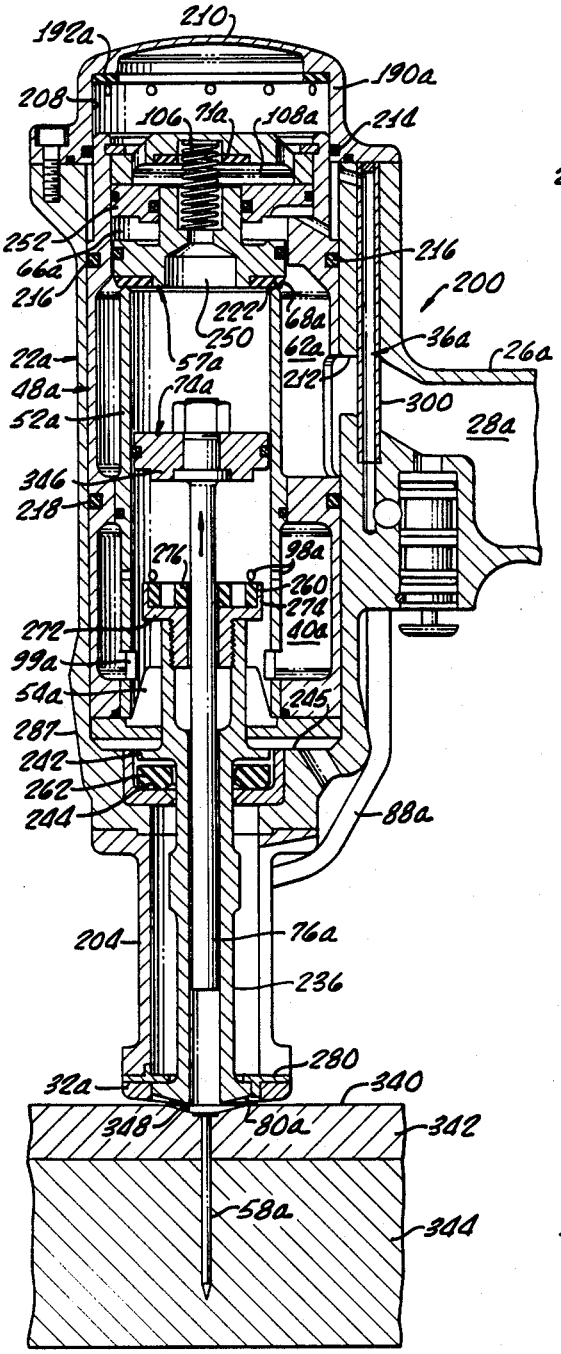
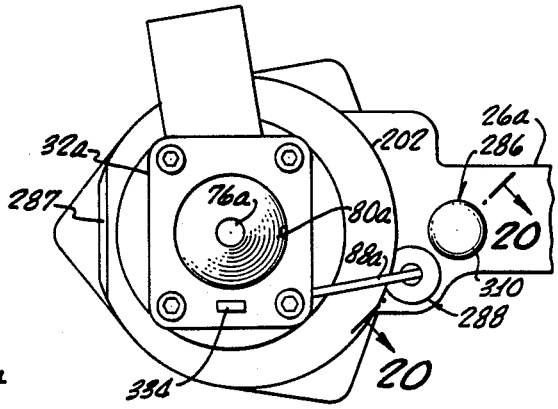
FIG. 19.
FIG. 20.
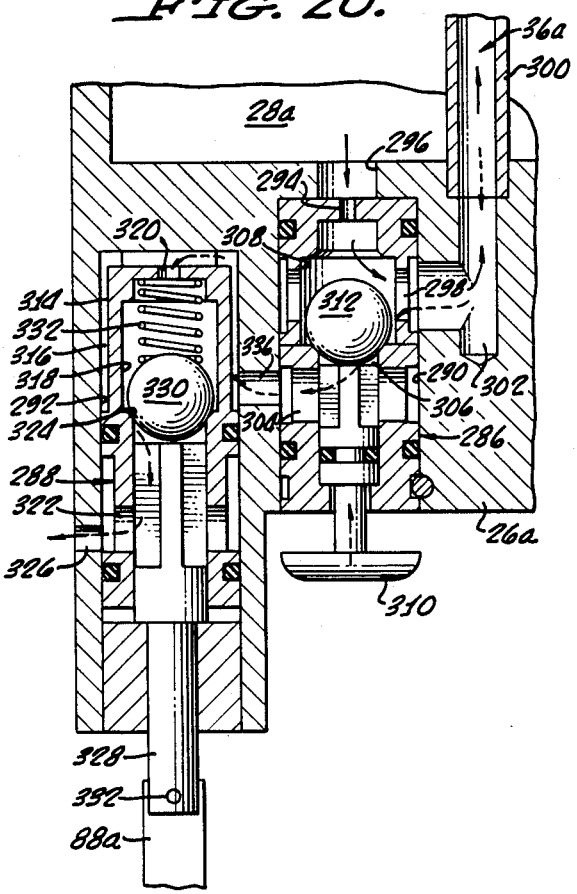

PNEUMATIC FASTENER-DRIVING TOOL AND METHOD

The present application is a continuation-in-part application under 35 USC 120, of prior application Ser. No. 06/664,944, filed Oct. 26, 1984, now U.S. Pat. No. 4,566,619 which is a file wrapper continuation application under 37 CFR 1.62 of application Ser. No. 06/171,720, filed July 24, 1980, now abandoned, which was a continuation-in-part of application Ser. No. 084,367, filed Oct. 12, 1979, now abandoned, which was a continuation of application Ser. No. 899,514, filed Apr. 24, 1978, now abandoned.

FIELD OF THE INVENTION

This invention relates to pneumatically operated apparatus and systems for driving fasteners.

DESCRIPTION OF THE PRIOR ART

Pneumatic fastener-driving tools are widely used in the building industry to join structural components together. The tools commonly employ a piston type drive mechanism which, during its driving stroke, engages one of a series of fasteners fed to the tool to force the fastener into the components to be joined.

Various attempts have been made to use pneumatic tools of this type as nailers to secure drywall sheets to framing studs in the construction of walls. In the fastening of drywall or other wallboard sheets to wooden framing studs, three criteria must typically be met for approval of the wall construction under applicable building codes and to provide a smooth finished wall surface. First, the head of each of the driven drywall nails must be recessed in the drywall to a depth within a specified range. Secondly, it is necessary or desirable to dimple and slightly recess the drywall around the recessed heads of the driven nails so that the nail heads can be concealed with spackling or the like subsequently deposited in and around each of the dimples. Thirdly, each of the mounted drywall sheets must be held in firm abutment with each of its framing studs at each nail location.

Several pneumatic tools have been proposed to perform these multiple functions in a single operation, i.e., to simultaneously drive the nail and properly recess its head, form a dimple in the drywall around the nail head, and ensure a firm abutment between the drywall sheet and its supporting studs at each nail location. However, none of these prior art tools has satisfactorily accomplished these multiple functions.

The chief reason for the failure of conventional pneumatic fastener-drivers to satisfactorily drive, recess, dimple, and secure in one operation is that they recoil away from the drywall at the instant they are actuated. This heretofore unavoidable recoil renders it difficult to control the depth of either the nail recess or the dimple, since as the nail driving and dimpling mechanisms are being driven toward the drywall, the tool itself is being reactively thrust away from it. The nail recess and dimple depths are thus functions of the force with which the tool's operator presses it against the drywall during firing to limit recoil.

Therefore, with conventional fastener-driving tools, the achievement of uniform recess and dimple depths usually requires a rather high degree of skill and experience on the part of the tool's operator. Too little contact pressure between the conventional tool and the outer drywall surface results in unacceptably shallow nail recesses and dimples (or the complete lack thereof), while excessive pressures can cause breakage of the drywall. Either situation can result in rejection of the resulting wall structure by a building inspector and the necessity to rebuild it.

Tool recoil upon actuation can also cause loose connection points between drywall and studs (and thus a similar rejection of the wall by a building inspector) even though proper nail recesses and dimples have been formed. It is usually the case that the nailing surfaces of the studs, i.e., the surfaces which the inner surfaces of the installed drywall sheets must abut, are neither perfectly flat nor exactly coplanar. Thus, at many nail locations, a gap exists between the stud nailing surface and the inner surface of the drywall prior to the driving of nails at such locations. If the drywall is not pushed inwardly and held firmly against the stud while a nail is being driven into the stud, at least a portion of this gap remains after the nail is driven and the spackling is applied to its surrounding dimple. Subsequent inward pressure against the drywall (for example, when it is inadvertently bumped) can cause inward movement of the drywall relative to the stationary nail which causes the nail's head to pop the spackling out of its dimple and ruin the wall's finish.

To prevent this from occurring, it is necessary to press the tool against the drywall until the drywall is forced firmly against the underlying stud and to maintain the drywall/stud contact until the nail is completely driven. As in the case of trying to achieve uniform nail recess and dimple depths, this is made difficult by the rearward recoil of conventional pneumatic nailers at the instant of their actuation. If considerable pressure is not maintained between the tool and the drywall during firing, such firing recoil allows the drywall to spring out from the stud during firing so that the driven nail does not hold the drywall firmly against the stud.

Another problem associated with conventional pneumatic fastener-drivers involves the nailing of drywall at the corners of a room. At the typical room corner, each of the drywall nails must be positioned less than an inch from the adjacent wall. With this rather small distance, it is difficult to provide a tool having sufficient power so that it is capable of accurately and forcefully driving a nail into the underlying studding while simultaneously forming a proper dimple in this awkward location.

Conventional pneumatic nailers are not noted for their durability. In particular, when such tools are inadvertently "dry fired", i.e., when they are fired without adequate backup such as a framing stud, their fastener-driving and dimpling mechanisms are subjected to high stresses which cause rather rapid component fatigue and failure necessitating repairs and equipment downtime. This problem is particularly acute in tools in which there is metal-to-metal contact during either regular or dry firing of the tool.

In order to permit the nailing of a series of nails or other fasteners successively by an automatic tool, it has been previously proposed to secure the fasteners together in a "collation" of flexible assembly in which the nails or other fasteners are positioned in a row for successive pickup and use by the automatic fastening tool. Conventional collations involve the complete enclosing of a portion of each of the fasteners by a plastic or wire typically used to join the fasteners and form the collation assembly. Accordingly, when the fastener is driven into the wall or other parts to be joined, a portion of the plastic or wire joining material is frequently sheared off and embedded in the wall or other components, tending to mar the finished structure or otherwise diminish the consistency and effectiveness of the fastening process.

Accordingly, it is an object of the present invention to provide a pneumatic fastener-driving tool which eliminates or minimizes the abovementioned and other problems.

SUMMARY OF THE INVENTION

The present invention provides a pneumatically powered tool and method in which recoil is substantially eliminated during actual driving of a fastener from the tool into objects, such as a drywall sheet and an underlying framing stud, to be joined together. A novel mechanism within the tool postpones tool recoil until the fastener is completely driven and, additionally, significantly reduces the delayed recoil occurring after the fastener is driven.

This unusual and long sought after result allows even a relatively unskilled operator to hold the tool in firm contact with the drywall, thus holding the drywall directly against the stud until the tool has completely performed its fastening task. Each driven fastener thus forms a drywall-to-stud connection point for which the drywall directly abuts the framing stud even if the drywall must initially be deflected inwardly to contact the stud and would tend to spring outwardly during the use of a conventional pneumatic fastener-driving tool.

The unique recoil delaying and minimizing feature of the tool, which permits it to be hand-held in contact with the drywall during the entire time in which the fastener is being pneumatically driven, also allows the tool to recess the fasteners and form spackling dimples around them to uniform depths despite variations in contact pressure between the tool and the drywall at different drywall-to-stud attachment points.

In a preferred embodiment, the tool comprises a housing; a reciprocator assembly mounted for linear movement within the housing; a fastener-driving means, including a piston mounted within the reciprocator for parallel linear movement relative thereto for driving a fastener into a workpiece; and actuating means for pneumatically forcing the fastener-driving means through a driving stroke and simultaneously reactively driving the reciprocator assembly in an opposite direction within the housing.

During the driving stroke of the piston, recoil energy is absorbed by and causes the opposite motion of the reciprocator assembly. No significant amount of this recoil energy is transmitted from the reciprocator assembly to the housing during the driving stroke of the piston. The housing therefore remains substantially stationary during the actual driving of the fastener.

Subsequent to the driving stroke, a portion of the recoil energy in the oppositely moving reciprocator assembly is frictionally transmitted to the housing before impingement of the reciprocator assembly against the fastener-driving means. The majority of the recoil energy within the reciprocator assembly is transmitted not to the housing, but to the fastener-driving means which performs the unique functions of driving the fastener, dimpling, and subsequently cooperating with the reciprocator assembly to significantly reduce the total amount of tool recoil, a recoil which has been postponed until the fastener is already driven.

This cooperation between the fastener-driving means and the reciprocator assembly, which aids in stopping the oppositely moving reciprocator within the housing, is accomplished by energy absorbing means carried by the reciprocator assembly in fixed relation relative thereto. Subsequent to completion of the piston's fastener-driving stroke, these means collide with the piston and decelerate the reciprocator assembly.

According to a feature of the invention, dimpler means are provided for forming a rounded workpiece surface dimple around the fastener as it is being driven. In one form, the dimpler means has a work engaging face that has two tapered surfaces; one extending toward the handle of the tool and making an angle of approximately 20° (plus or minus about 4°) and a second angle extending forwardly from the center of the dimpling surface making an angle which is approximately 5° less than that of the rearwardly extending tapered surface, so that the dimple formed when the tool is oriented on a surface perpendicular to the axis of the driving piston is substantially the same as when the tool is tilted back slightly to apply fasteners to drywall sheets positioned in the corner of the room. In another form, the work engaging face has a uniformly curved surface which permits the tool to form acceptable dimples in the drywall surface despite tilting of the tool to a slight degree in any direction during the fastening process.

Structural means may be provided for guiding and positioning the tool against a corner wall during the driving of fasteners into the adjacent corner wall to form proper dimples in such adjacent wall.

According to another feature of the invention, resilient means are provided for preventing rigid collision during the fastening process between the fastener-driving means, the dimpling means, and the housing to thereby greatly prolong the life of the tool and prevent damage to its components even during dry firing of the tool.

In accordance with another aspect of the invention, a collation, or series of fasteners which are mechanically held together by flexible plastic or wire material for ease in feeding by the tool, is provided. The collation has a configuration which avoids the carrying into the workpiece of any residual portion of the extended collation material. Preferably to accomplish this function, the collation material has a release slot or a thin membrane extending along the surface of each fastener shank so that the fastener may be readily detached from the collation and the collation material may be disposed of without inclusion into the assembly being fastened together.

In accordance with additional aspects of the invention, (1) the reciprocator assembly may be provided with an inner cylinder in which the piston is mounted and a poppet valve assembly positioned at an open end of the cylinder which normally prevents the actuation of the piston and which is pneumatically opened to initiate the driving action of the piston at the beginning of each cycle of operation of the tool; (2) the reciprocator and the piston are returned to their ready-to-fire positions following each power cycle by pneumatic means which also apply closing force to the poppet valve; (3) the energy absorbing means carried by the reciprocator assembly comprises a resilient bumper positioned at a forward end of the reciprocator assembly; (4) the reciprocator assembly is provided with a surge reservoir for initially supplying driving power to the piston; (5) reservoir chambers are provided in the housing through which pressure is developed to return the reciprocator assembly and piston to their ready-to-fire positions and from which a fastener feeder may be driven; (6) the housing may be provided with a dimpler retaining (and guiding) cap around the periphery of the dimpler and the dimpler may be pressed back into the retaining cap to enable operation of the tool and to assure uniform dimpling; and (7) safety interlock means, including a safety interlock member extending between a forward end of the housing and the actuating means, may be provided to preclude firing of the tool unless the interlock member is in a depressed position.

BRIEF DESCRIPTION OF THE DRAWINGS

FIG. 18 is a view similar to FIG. 17 showing the piston and the reciprocator assembly being pneumatically returned to their ready-to-fire positions;

FIG. 19 is a bottom end view of the tool illustrated in FIGS. 16 through 18; and FIG. 20 is an enlarged cross-sectional view taken along line 20—20 of FIG. 19.

DETAILED DESCRIPTION OF THE DRAWINGS

Figure 1:
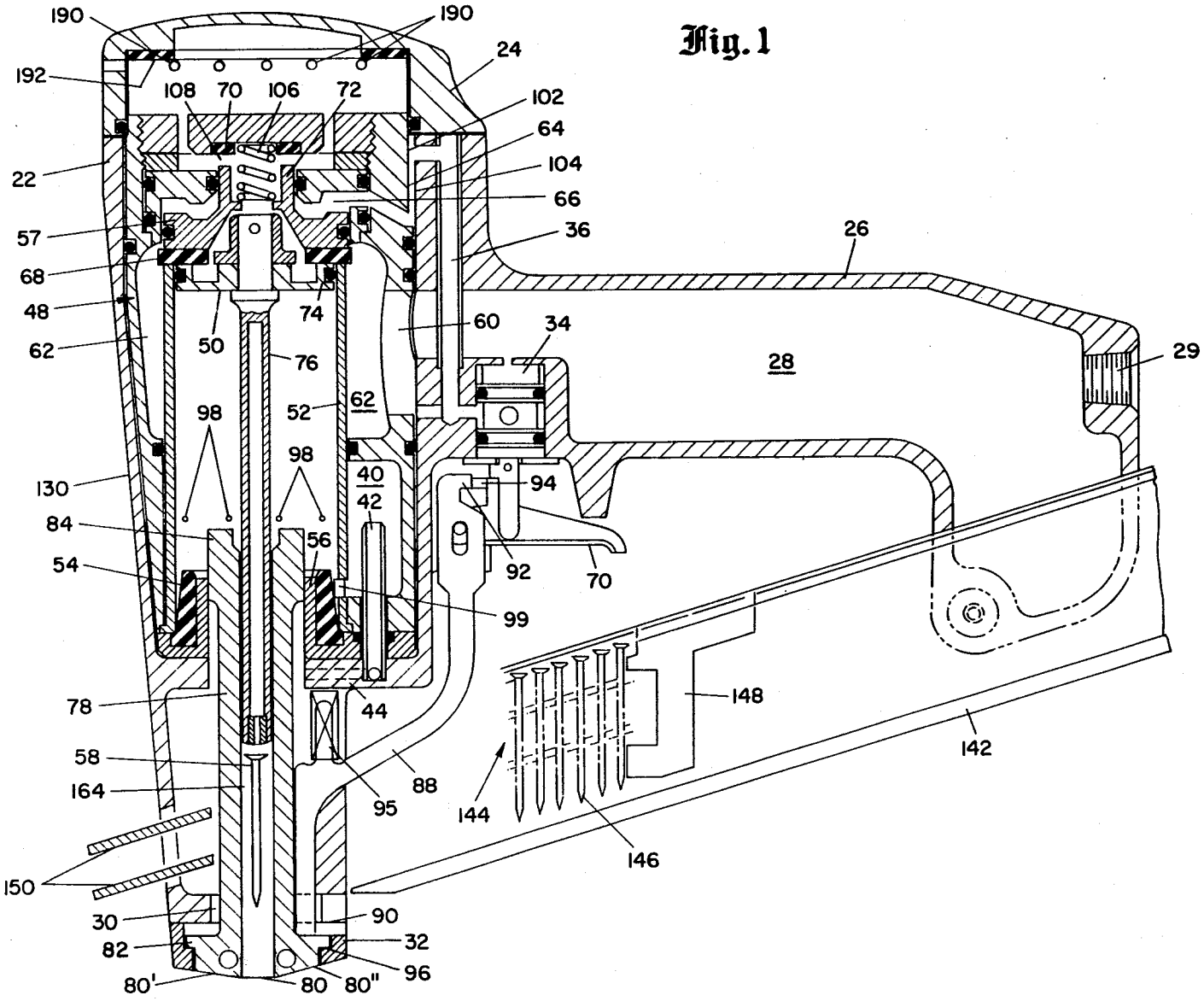
FIG. 1 is an overall view of a fastener-driving tool embodying principles of the present invention.

FIG. 1 illustrates a pneumatically powered fastener-driving tool embodying principles of the present invention and including housing 22 and upper head cover 24. The housing has integral handle 26 by which the operator may grasp and manipulate the tool. Handle 26 is cored to provide storage chamber 28 into which a pressurized gas, such as air, is introduced through opening 29 by a coupling connection from an external source to provide compressed air to various passages, valves, and reservoirs for operating the tool as described in greater detail below. Housing 22 has lower opening 30, and at the operating end of the tool beyond opening 30, may have dimpler retaining cap 32.

Handle 26 has provision for retaining a manually operable actuation valve 34 and contains air passageway 36, which serves to vent pressure and initiate operation of the tool, as described below, when valve 34 is operated.

A fastener progression mechanism 38 (see FIG. 4) may be powered by air pressure from reservoir 40 (see FIG. 1) through transfer tube 42 and passageway 44 leading to piston 46, as described in greater detail below.

Now, returning to FIGS. 1 and 2, the presentation of FIG. 2, with the entire reciprocator assembly 48 and fastener-driving piston assembly 50 shown separately from the enclosing housing, is intended to emphasize the essentially self-contained nature of the reciprocator and driving piston assemblies. More specifically, with piston 50 being mounted for movement within cylinder 52, which is part of the reciprocator assembly, and finally abutting on resilient stop 54 and positive stop 56 at the end of its driving stroke, very little or substantially no recoil is transmitted to enclosing housing 22 of the tool during such driving stroke. As mentioned above, as driving piston 50 drives fastener 58 (see FIG. 2) downwardly, and the piston moves downward within cylinder 52, the entire reciprocator assembly 48 moves upwardly within housing 22. However, the reciprocator assembly is many times heavier than the driving piston and accordingly only moves a fraction of the distance of the piston.

Figure 2:
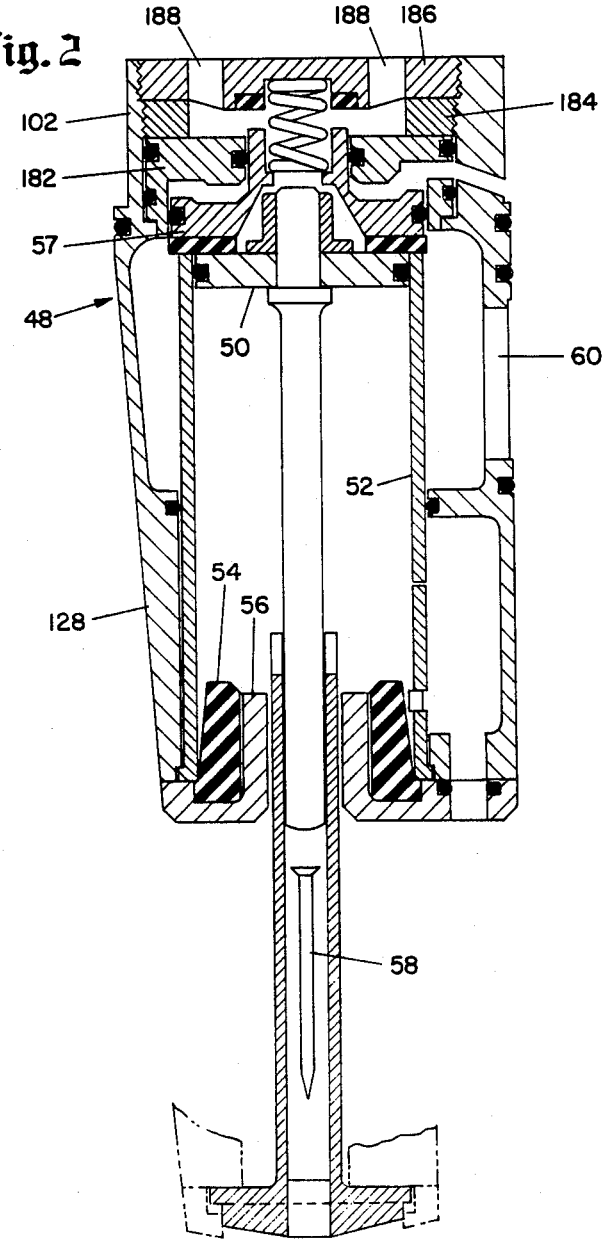
FIG. 2 is a showing of the central reciprocator, piston, and dimpling structure removed from the tool of FIG. 1.
Figure 7:
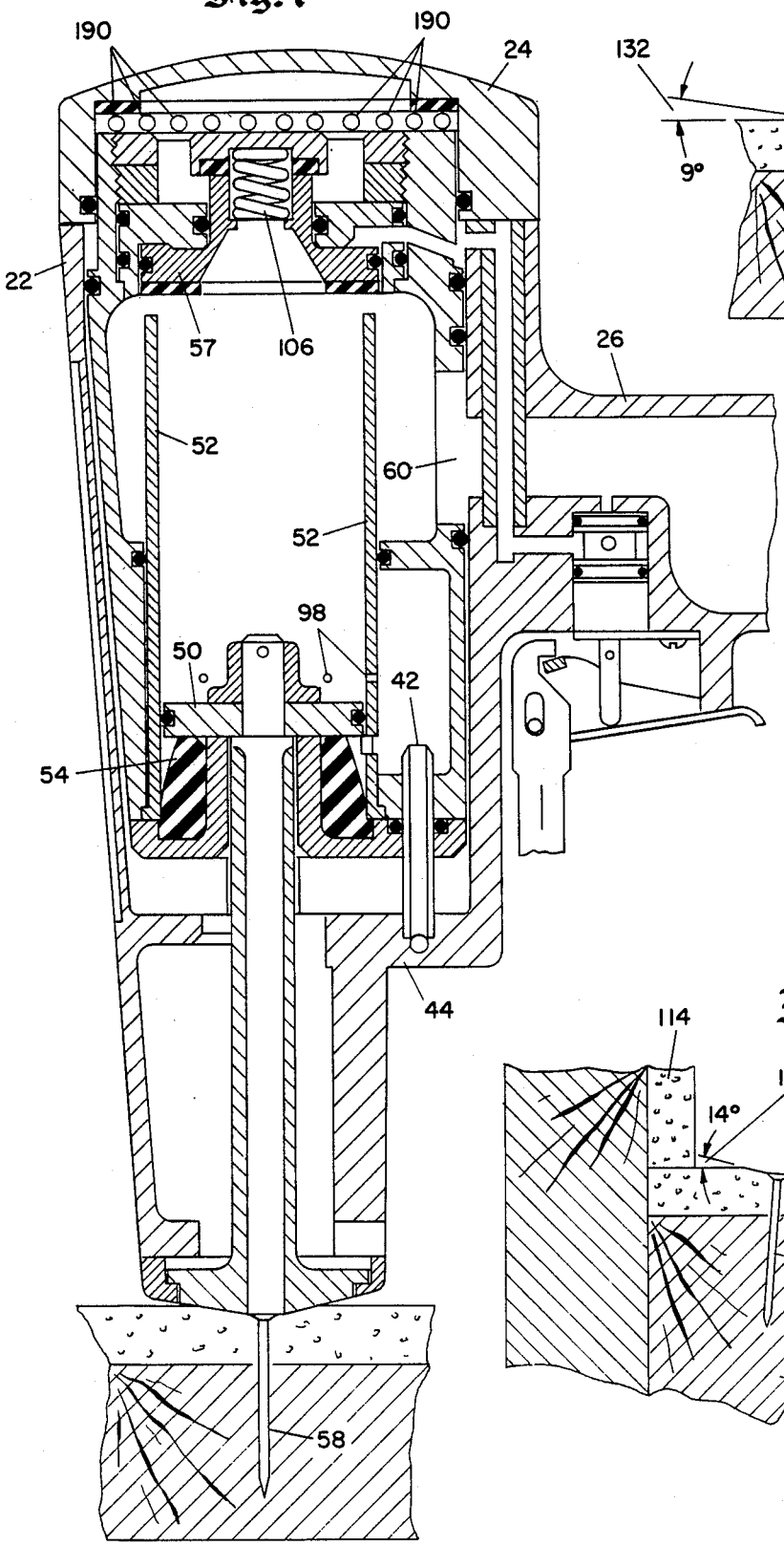
FIG. 7 is a detailed assembly view similar to the showing of FIGS. 1 and 2, but with the piston and the reciprocator in their most advanced and retracted positions, respectively.

Now, returning to the most basic mode of operation of the pneumatic portion of the system with reference to FIGS. 1, 2, and 7. In the rest position, as shown in FIG. 1, poppet valve assembly 57 is closing the upper end of drive cylinder 52. At this stage of the cycle, high pressure air is supplied from chamber 28 in handle 26 through opening 60 in the outer wall of reciprocator assembly 48 into surge chamber 62, formed within the reciprocator assembly which circumscribes cylinder 52. At this time, high pressure air from chamber 28 in handle 26 is supplied though valve 34 and passageway 36 to reciprocator return passageway 64 and into poppet valve pressure chamber 66. Poppet valve assembly 57 and seal 68, which it carries, is therefore held firmly downward on the top of cylinder 52.

Upon actuation of trigger 70, however, valve 34 is actuated to vent the air from passageway 36 and chamber 64 and from chamber 66 above the poppet valve. Then, with the area of poppet valve assembly 57 and its associated seal 68 being slightly greater than that of cylinder 52, the poppet valve assembly is rapidly moved upward to open the upper end of cylinder 52 and to close the seal between resilient seal member 71 and cylindrical upper end 72 of the poppet valve assembly. Surging air from chamber 62 enters the cylinder barrel onto piston head 74 of piston assembly 50 in an explosion-like manner immediately following the rapid actuation of the poppet valve assembly. Piston assembly 50 with its associated fastener-driver portion 76 is moved with high acceleration in the direction of fastener 58.

The fastener, upon being contacted, is forced into the workpiece, which may be drywall, and subsequently into the drywall supporting substructure.

As mentioned in the introduction of the present specification, following the nailing of a particular nail into the drywall, it is desired that the drywall be dimpled or recessed so that the head of the nail may be spackled to prepare for the painting or wallpapering of the wall. Referring to FIG. 1, the dimpling is accomplished by dimpler assembly 78, including curved dimpling face 80, movement-controlling flange 82, and striking face 84. Initially, when it is desired to operate the tool, it must be placed in engagement with the drywall or other workpiece into which the fastener is to be driven. An interlock structure, including member 88, may be provided to prevent operation of trigger 70 until dimpler assembly 78 is firmly in engagement with the workpiece and surface 80 is pressed so that movement-controlling flange 82 engages overlaying flange 90 in the nose of housing 22. When this occurs, interlock member 88 is moved upwardly so that stop protrusion 92 no longer blocks actuation of trigger 70 by interfering with the motion of element 94 secured to the trigger assembly. With regard to the foregoing mode of operation, it may be noted that spring 95 normally biases interlock member 88 and the dimpler is pressed against the workpiece into which the fastener is to be driven.

Following the driving of fastener 58, the lower surface of piston 74 will engage driving surface 84 at the upper end of dimpling assembly 78. During the course of the driving of the fastener, the movement of the piston has been decelerated to some extent. Resistance due to dimple formation as surface 80 depresses the surface of the drywall board now causes considerable additional deceleration of the piston.

Immediately after complete deceleration of the fastener-driving piston assembly as noted above, resilient member 54, which is secured to the lower end of the reciprocator assembly, engages piston assembly 50. Since piston assembly 50 is now resting upon the lower end closure of reciprocator assembly 48, thrust forces are now equal between the piston and the reciprocator assembly and both are decelerated to an almost complete stop, the tool reaching the end of its work stroke cycle.

During the work stroke, static air directly in the course of piston head 74 is transferred into the lower storage chamber 40 through a peripheral series of small openings 98 and several larger apertures 99. After head 74 of piston 50 has passed openings 98, and before pressure is released above the piston, additional pressurization of piston return chamber 40 is provided through small openings 98. This pressure which is built up may be transmitted through tube 42 to mechanism 38 which removes a fastener from the collation and inserts it into the driving chamber in the position shown by fastener 58 in FIG. 1, for example.

After completion of the work stroke, the system is in the position shown in FIG. 7 of the drawings. Trigger 70 is then released by the operator. At the instant of trigger release, the normally open control valve 34 receives compressed air from reservoir 28 in handle 26 and the higher pressure is transmitted through passageway 36 to reciprocator assembly return compression chamber 64 and subsequently into poppet valve pressure chamber 66.

It may be recalled that the entire reciprocator assembly 48 has been moving upwardly as the piston has been moving downwardly. In order to return the reciprocator assembly to its lower position ready for the next stroke, the reduced diameter of upper portion 102 of the reciprocator assembly relative to the diameter of passageway 104 provides the necessary piston area for downward force to be applied from peripheral reciprocator assembly return compression chamber 64. Simultaneously, poppet valve compression chamber 66, upon receiving pressure and with the assistance of compression spring 106, will shift poppet valve assembly 57 to the position shown in FIG. 1, in which power cylinder exhaust port 108 at seal 71 is opened and the upper end of power cylinder 52 is closed thereby removing high pressure from the upper surface of piston head 74. The compressed air from chamber 40 will now apply pressure to the lower surface of piston head 74 and return it to its position as shown in FIG. 1.

Now that the basic mode of operation of the system has been described, attention will be directed to some of the other features of the present invention.

Figure 8:
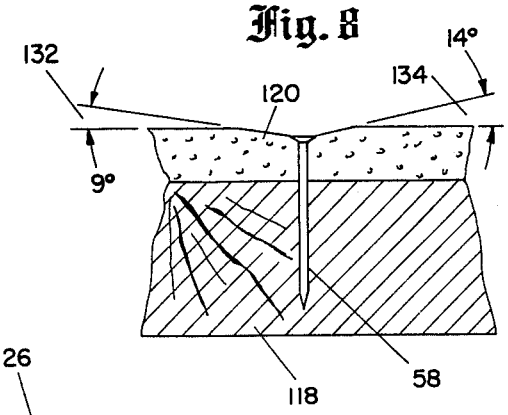
FIGS. 8 and 9 show the dimpling action of the tool of the present invention, both in connection with a flat surface nail insertion (FIG. 8) and in connection with the insertion of the nail into studding at the corner of a room (FIG. 9)
Figure 9:
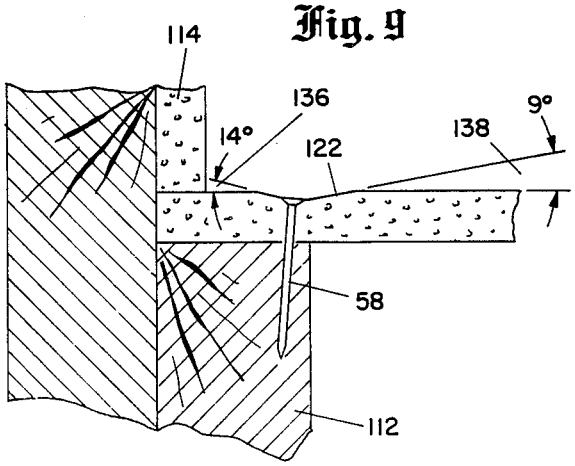

A number of structural features of the present invention are directed to the situations shown in FIGS. 8 and 9 of the present drawings, and to the particular problem posed by FIG. 9, that of driving a fastener into a stud at the corner of a room. In FIG. 9, a nominal two by four 112 is shown, having a thickness of approximately one and one-half inches. With drywall 114 in place, the projection of two by four 112 from the surface of drywall 114 is only about one inch. The problem of providing a sufficiently powerful fastener-driving tool, which is mechanically sound and which will accomplish the needed job, has been one which has plagued the industry for many years. In the following portion of the present specification, the design features which contribute to an effective accomplishment of this difficult job will be developed.

FIG. 8 is included by way of contrast to show the securing of fastener 58 through drywall sheet 116 into studding 118. In addition, dimple 120, to which spackling will be applied, may also be noted. Similarly, dimple 122 in FIG. 9 may also be noted. The details of the formation of these two dimples will be discussed in greater detail below.

Figure 3:
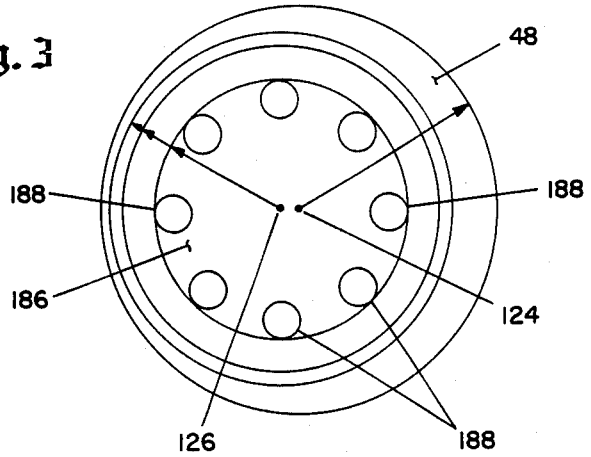
FIG. 3 is an end view of the reciprocator and piston assembly of FIG. 2.

One feature of the present invention which may contribute to the mode of operation by which a fastener may be powerfully driven into the drywall and the underlying studding in the corner of a room involves the location of the driving piston eccentrically in the containing reciprocator assembly, as best shown in FIG. 3 and associated FIG. 2. In the diagram of FIG. 3, the center of the reciprocator assembly is represented by point 124. The center axis of cylinder 52 and the axis of movement of piston 50 is represented by point 126, however, somewhat shifted away from point 124. Of course, although spaced, these two axes are parallel.

This shifting of the axis of movement of the cylinder is for the purpose of permitting the drive piston to be closer to the adjacent wall when fasteners are to be driven into the corner of a room. In order to further work toward this goal, one face 128 of the reciprocator assembly (see FIG. 2) is tapered, this tapering occurring on the side of the reciprocator assembly toward which the inner eccentrically mounted drive piston is located. This inner construction is manifested on the outer surface of tool housing 22 as face 130 which is similarly tapered. This face 130 appears in FIG. 4 as a triangular area wherein the generally cylindrical outer configuration of housing 22 is modified. The angle by which one face 130 of housing 22 is tilted with respect to the axis of the power piston may be approximately five degrees, although a somewhat greater or lesser angle may be employed.

Figure 6:
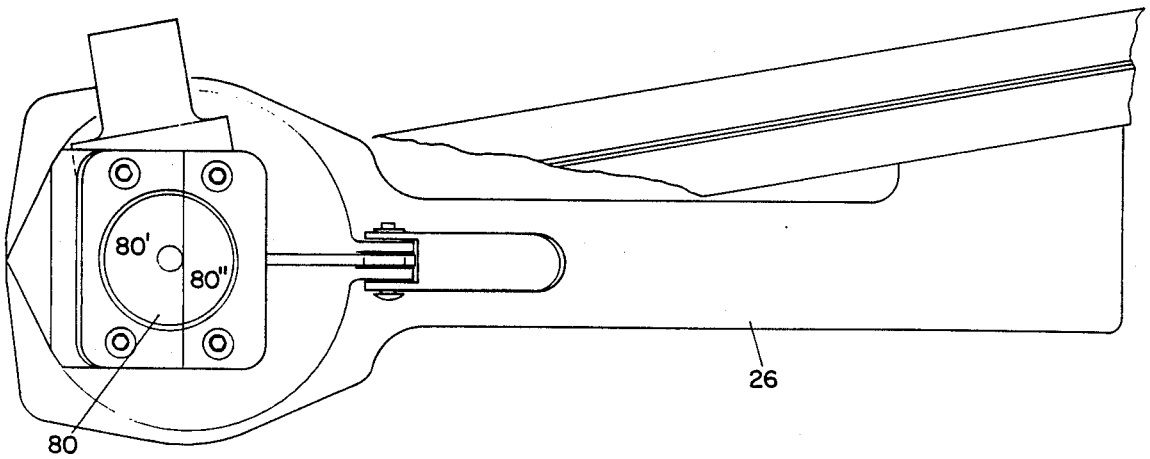
FIG. 6 is a bottom view of the tool of FIG. 1 showing the dual tapering of the dimpler mechanism.

Now, the configuration of dimpler face 80 on dimpler assembly 78 will be considered. Dimpler face 80, as shown in FIG. 6, has a complex curved shape with the portion 80' being conical but with one cone angle and portion 80'' having a slightly different conical angle. More specifically, with the axis of driving piston assembly 50 being perpendicular to the work surface, surface 80' away from handle 26 may make an angle of approximately fifteen degrees with the work surface, while surface 80'' may make an angle of approximately twenty degrees with respect to the drywall or other work surface. With the axis of drive piston 50 being perpendicular as shown in FIG. 8, nail 58 is driven perpendicularly into drywall 116 and underlying studding 118 and the surface formed by dimpler surface 80' makes an angle 132 of approximately fifteen degrees with the outer surface of drywall 116. In addition, angle 134 which is formed by surface 80'' is approximately twenty degrees. However, with reference to FIG. 9, nail 58 is driven by abutting face 130 of housing 22 against wallboard sheet 114. Accordingly, nail 58 is driven in at an angle approximately five degrees off of vertical; angle 136 is then approximately twenty degrees and angle 138 is approximately fifteen degrees.

After considerable experimentation, it was determined that good dimpling action could be achieved without ripping or otherwise tearing the surface paper on the wallboard, both for the vertical driving orientation and also for the angled orientation as depicted in FIG. 9. In addition, through the use of the eccentrically mounted piston in the reciprocator assembly together with the tapered reciprocator assembly and the tapered outer surface of the tool housing, the tool could be readily located and properly oriented in the corner of a room as fasteners are driven. Further, as mentioned elsewhere, the driving action is both powerful and without significant recoil, while concurrently successfully recessing or dimpling the location of the fasteners to precisely the right depth without the need for skilled workmen.

Attention will now be directed more closely to the arrangements for feeding fasteners into the fastener driver tool. In this connection, attention is again directed initially to FIG. 1 in which nail or fastener magazine 142 is shown carrying collation 144 of nails 146. Forcing the nails to the left as shown in FIG. 1 is spring biased follower 148 which rides inside magazine 142. To the left in FIG. 1 is shown expended collation media 150.

Figure 10:
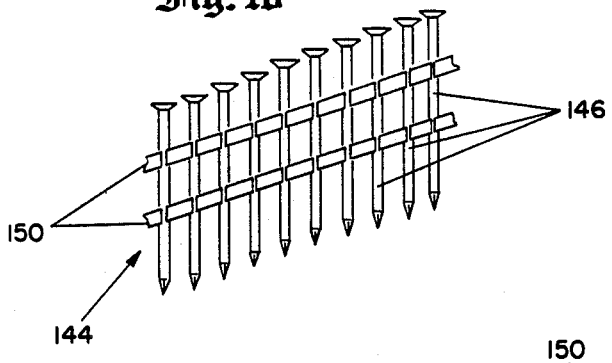
FIG. 10 is a collation which may be employed in connection with the present invention.
Figure 11:
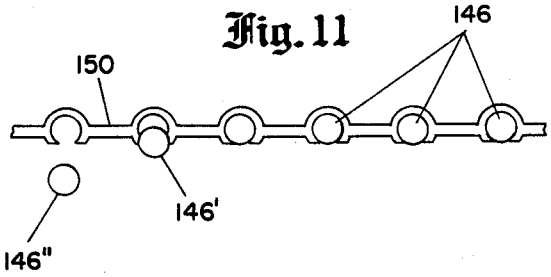
FIG. 11 is a sectional view taken through the nails and toward the collation of FIG. 10.

FIG. 10 shows collation 144 including nails 146 and collation media 150 separate from magazine 142. As shown in FIG. 11, collation material 150 may be cut away or otherwise removed along one side substantially tangent to the surface of nails 146, or a thin membrane (0.003/0.008 in. thick) may be present over the side of the nails. This permits easy removal of the nails, as disclosed above, by pressure applied transversely to move nails 146 out from collation media 150 as indicated by nails 146' and 146'', in accordance with the showing of FIG. 11.

Figure 4:
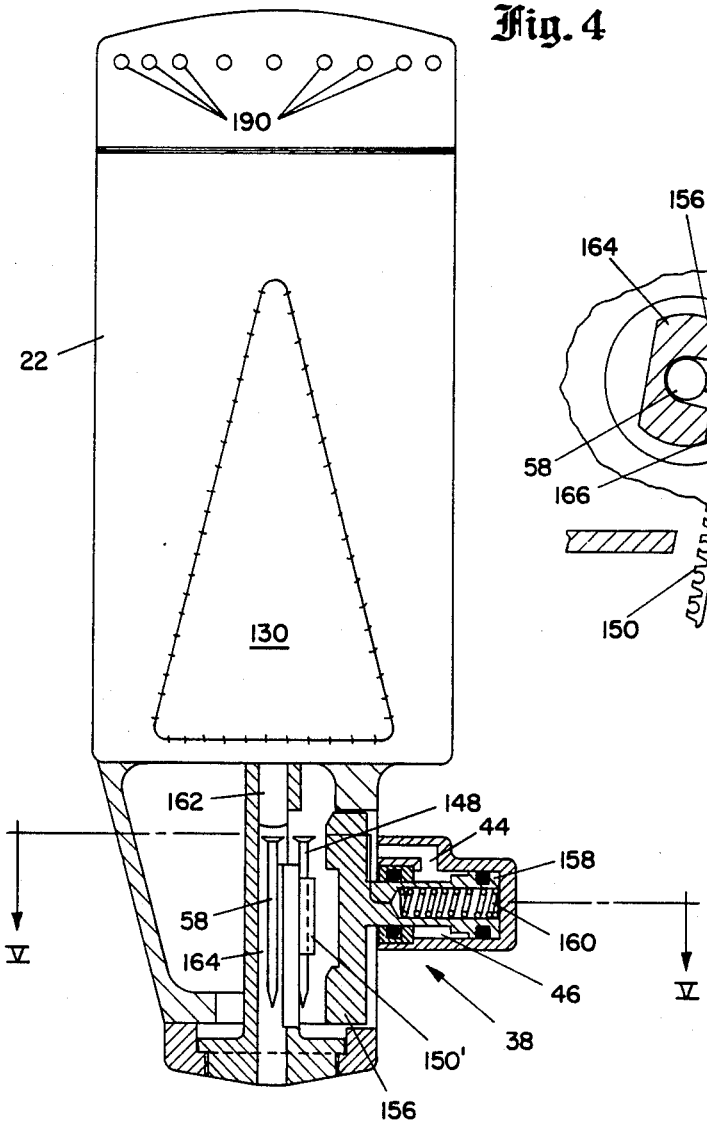
FIG. 4 is a front view of the tool of FIG. 1 taken from the side opposite the handle.
Figure 5:
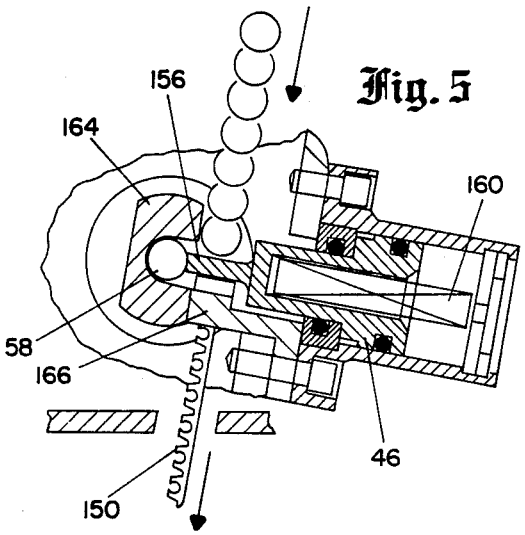
FIG. 5 is a view taken along the lines V—V of FIG. 4.

The mode of operation of the mechanism for removing the nails from collation media 150 will be discussed primarily in connection with FIGS. 4 and 5 of the drawings, with reference also being made to FIG. 1. Initially, FIG. 4 shows nail 58 in position for driving with the next nail 58' to be inserted still being held by collation media 150, which may be either in the form of a single strip (see FIG. 12) or as a pair of strips as shown in FIG. 10 and also in FIG. 1. In either event, the side of the collation from which nails 146 may be easily removed is to the left as shown in FIG. 4. The pneumatically operated push bar 156 is in the retracted position in view of the force applied through passageway 44 to actuate piston 46 to the right, as shown in FIG. 4. For convenience of illustration, lower end 162 of the driving piston rod is shown immediately above, prepared to engage the head of nail 58 in the position it will have prior to, and at the time of, actuation. However, the actual retraction of piston 46 does not occur until the power stroke is initiated. As soon as piston assembly 50 is retracted and the pressure in chamber 40 drops, nail insertion bar 156 is moved forward to shift next nail 58' (FIG. 5) into the tool fastener receiving raceway or channel 164, which is within dimpler 78. As shown in FIG. 5, nail insertion bar 156 supports nail 58 by the head until it is driven forward by head 162 of driver piston assembly 50. Stop member 166 is provided to extend across the path of the collated fasteners between collation media 150, or above and below collation media 150' if a single strip of the type shown in FIG. 12 is employed.

Figure 12:
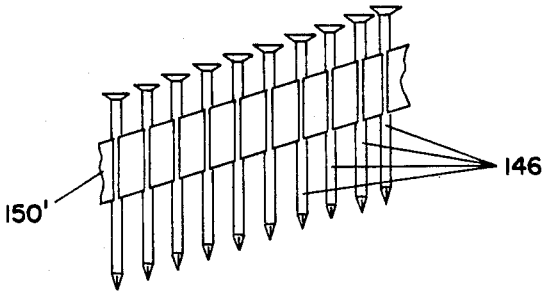
FIGS. 12 and 13 are side and cross-sectional views, respectively, of an alternative form of collation using a single strip of plastic.
Figure 13:
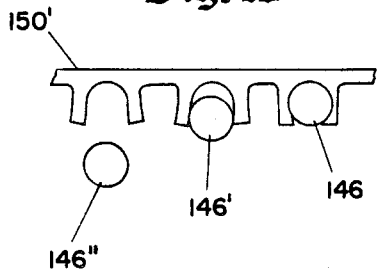

As mentioned above, the single plastic strip shown by collation media 150' in FIG. 12 may be employed to hold collated nails 146 instead of the dual strips of collation media 150 as shown in FIG. 10. A top view of collation media 150' together with nails 146, 146', and 146'' depicting the manner in which nails are removed from the media is shown in FIG. 13.

Figure 14:
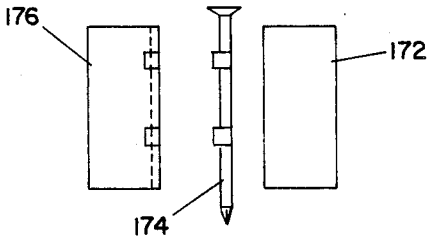
FIG. 14 is a diagrammatic showing of an apparatus for forming the collation of FIGS. 10 and 11.

FIG. 14 is a schematic showing of a process for providing a partial break or thin membrane in continuous double collation strips of the type shown in FIG. 10. More specifically, fasteners are currently available using double plastic strips of the type shown in FIG. 10 with no breaks adjacent the sides of the nail. This break, which is shown in FIG. 10 and which is of the type shown in FIGS. 12 and 13, may be introduced into presently existing collation arrangements by use of hot-forming plate 172, which may be pressed against the side of collated nails 174 as they are engaged on the other side by unheated or cold plate 176. Using this type of arrangement, the hot plate may engage each nail successively on its side to create a tangential slot along the side of the nails to permit easy removal. With this type of slot, as shown in FIG. 10, and also in the solid web arrangement of FIGS. 12 and 13, the fasteners may be readily removed from the collation media and the nails pounded into place with no accompanying residue from the collation media to interfere with or mar the surface of the members to be secured together. Alternatively, in lieu of a complete slot, the hot plate may merely thin the collation media so as to produce a weakened area where a controlled break can occur.

Incidentally, in many of the structures described in the present specification where the reciprocator is slidably mounted within the housing or where the piston is slidably mounted within the cylinder, low friction high quality seals may be provided. These may be provided by known techniques involving the use of low friction strips or rings, which are relatively thin and which are backed up by rubber O-rings, to apply sealing pressure to the low friction material which actually contacts the oppositely moving surface. This type of low friction sealing arrangement is available commercially and does not per se form part of the present invention. However, this may be advantageously used in the implementation of the present invention.

In the foregoing description, most of the key operating parts are described. Certain less critical parts were not discussed in detail, and some of these will now be mentioned. Specifically with reference to FIG. 2, poppet valve assembly 58 was referenced, but some of the associated parts were not specifically mentioned; in particular, poppet valve retainer body 182. Retainer body 182 is held in position by threaded retainer ring 184 and outer threaded retainer plate 186, which is provided with a plurality of exhaust holes 188 to complete the structure at the upper end of the reciprocator assembly. In order to permit the exhaust of air from housing 22, cap 24 is also provided with a plurality of peripheral openings 190. Adjacent to openings 190 is rubber pad 192, which is of washer-shaped configuration, against which the reciprocator assembly may impinge in the unusual case where it is forced to its extreme upper position.

We will now return to consider angled face 130 on the housing (see FIGS. 1 and 4), which is useful in connection with driving fasteners near the corner of a room, as shown in FIG. 9. In order to avoid interference with the handle as the housing is brought into contact or immediate proximity with the adjacent wall, the handle should be oriented at least 90° around the axis of the main portion of the housing, and preferably on the side of the housing opposite slanted face 130 of the housing. Also, the angle of face 130 with respect to the axis of the drive piston should be approximately equal to the difference between the angles of faces 80' and 80'' of dimpler surface 80 with respect to the axis of the drive piston. In the present embodiment, this is the difference between 15° and 20°, that is 5°. On a more general basis, the angles may be varied somewhat but should be coordinated for optimum results.

The present pneumatic fastener driving tool would also be applicable to the driving of fasteners which have flush fastener heads and which do not require dimpling of the type described in detail hereinabove. For driving pins into concrete or other similar work not requiring dimpling, the movable forward dimpling member would be replaced by a movable member, and the driving piston would be arranged to have a driving stroke just sufficient to properly drive the pin or nail the desired depth into the workpiece and would then impinge on the moveable member and substantially concurrently impinge against the resilient and positive stop members of the reciprocator.

ALTERNATE EMBODIMENT

Figure 15:
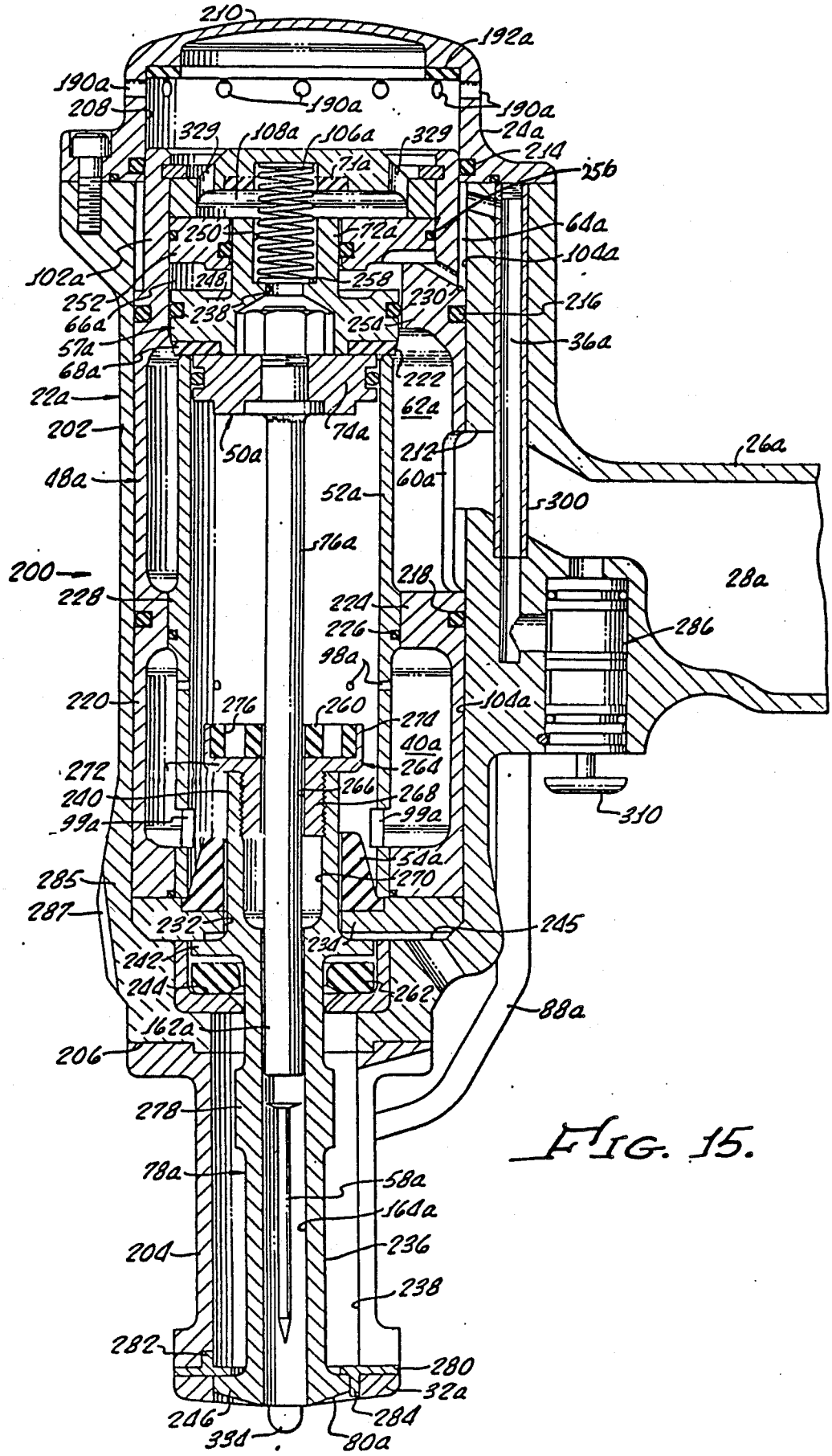
FIG. 15 a cross-sectional view through an alternate, greatly preferred embodiment of the tool with its components in their ready-to-fire positions, the fastener feeding mechanism now being illustrated.

Illustrated in FIG. 15 is an alternate and preferred embodiment 200 of the previously described tool. Although tool 200 has several major improvements which are described below, many of its components are similar to those of the tool of FIG. 1 in both structure and function. For ease of comparison, such similar components have been given reference numerals identical to the corresponding components of the tool of FIG. 1 but with the suffix "a" added. The fastener-feeding apparatus of tool 200 is also similar to that of the previously described tool embodiment, but is neither shown in FIGS. 15 through 20 nor discussed in the following description, which is directed primarily to the structural improvements to tool 200 and its novel recoil controlling mechanism.

BASIC STRUCTURE OF TOOL 200

Referring to FIG. 15, which cross-sectionally illustrates the components of tool 200 in their ready-to-fire positions, tool 200, like the tool of FIG. 1, includes a housing **22*a* having an elongated generally cylindrical head portion 202, handle portion 26*a* extending radially outwardly from the head portion, and nose portion 204 extending axially outwardly from the lower or forward end 206 of head 202**.

Formed within head 202 is an axially extending cylindrical recoil chamber **104*a* having a reduced diameter upper portion 208 adjacent upper end 210 of head 202. Reservoir chamber 28*a* adapted to receive high pressure air from a source is formed in handle 26*a* and communicates with chamber 104*a* through internal housing passage 212**.

Slidably mounted in chamber **104*a* by means of low friction O-ring seals 214, 216, and 218 are recoil receiving and controlling means in the form of a metal reciprocator assembly 48*a*, comprising cylindrical body 220, internal drive cylinder 52*a* telescoped longitudinally upwardly into body 220 and having an open upper or inner end 222, and internal poppet valve 57*a***.

The upper end portion of cylinder 52 is enveloped by annular surge chamber **62*a* formed within reciprocator body 220 and communicating with housing passage 212 through side inlet port 60*a* formed in body 220. Also formed within body 220 and positioned below surge chamber 62*a*, is compression or return chamber 40*a* which encircles the lower portion of internal cylinder 52*a*. Surge chamber 62*a* is isolated from compression chamber 40*a* below it by means of internal reciprocator body flange 224 which engages O-ring seal 226 on a radially enlarged annular exterior portion 228 of internal cylinder 52*a***.

Reciprocator body 220 has a lower portion slidably received in the lower portion of housing chamber **104*a* and a reduced diameter upper end portion 102*a* which is slidably received in the reduced diameter upper portion 208 of the chamber 104*a*. At the juncture of the lower and upper portions of reciprocator body 220 is an annular upwardly facing ledge 230 which functions, as described below, to return reciprocator assembly 48*a* to its ready-to-fire position wherein the lower end of body 220 is adjacent the lower end of chamber 104*a***.

Slidably mounted within internal drive cylinder **52*a* is drive piston 74*a* upon which is mounted a downwardly projecting fastener striking rod 76*a*. In its ready-to-fire position, drive piston 74*a* is at the upper end of internal cylinder 52*a*. The lower end of rod 76*a* projects through axial opening 232 in the lower end of reciprocator body 220, opening 232 being defined by an axially inwardly directed annular flange 234** on the bottom end of the reciprocator body.

One of the major structural changes in tool 200 is in its dimpler mechanism **78*a*, which includes an elongated dimpler member or shaft 236 mounted in tool 200 for limited longitudinal reciprocating movement along the axis of movement of piston 74*a***, the piston movement axis being laterally offset relative to the movement axis of the reciprocator assembly, as previously described for the initial embodiment.

Dimpler shaft 236 extends longitudinally through opening 238 extending axially through housing nose portion 204 with a transversely enlarged upper end portion 240 of the dimpler shaft being slidably received in the lower reciprocator body end opening 232 and projecting upwardly into internal cylinder 52*a*. The lower end portion of the dimpler shaft extends through opening 238 extending axially through housing nose portion 204. At the juncture of the upper and lower end portions of the dimpler shaft is a radially outwardly projecting external flange 242 which is positioned and captively retained between the lower end of the reciprocator body and bumper 262 mounted on internal shoulder 244 formed in the housing below the bottom end of chamber 104*a*. At the lower end of the dimpler shaft is external flange 246 having a downwardly facing work engaging face 80*a*. An axially extending opening 164*a* is formed through the entire length of the dimpler shaft and slidably receives a lower portion of fastener striking rod 76*a*, as indicated in FIG. 15. For reasons described below, work engaging end face 80*a* of the dimpler shaft tapers uniformly upwardly and radially outwardly (at an angle of approximately 20°) from around the perimeter of axial shaft opening 164*a*.

Poppet valve 57*a* has a cylindrical base 248, a reduced diameter central cylindrical boss 72*a* extending upwardly from the base, and an axial passage 250 extending from the underside of the base to the upper end of the boss. The poppet valve is slidably mounted within the reciprocator body for axial reciprocating movement therein between upper end 222 of internal cylinder 52*a* and the underside of internal flange 252 within reciprocator body 220. Above flange portion 252 is a relief chamber 108*a* within the reciprocator body which communicates with reduced diameter upper chamber portion 208. Valve boss 72*a* is slidably received in an opening defined by internal flange 252, and valve base 248 is slidably received within internal flange portion 254 of the housing head positioned below flange portion 252.

With the poppet valve in its ready-to-fire position, annular seal 68*a* on the underside of the valve base seats against upper end 222 of internal cylinder 52*a* and isolates the interior of the cylinder from surge chamber 62*a*. With the poppet valve in this position, valve control chamber 66*a* is formed between the upper end of valve base 248 and the underside of internal flange portion 252. An annular O-ring seal 256 on valve base 248 isolates valve control chamber 66*a* from surge chamber 62*a*. The poppet valve is biased downwardly toward its ready-to-fire position by helical compression spring 106*a* extending between the upper end of reciprocator body 220 and interior shoulder 258 within valve boss 72*a*.

In addition to resilient washer 192*a* positioned at the upper end of chamber 104*a* which precludes rigid impact between the reciprocator assembly and the upper end of the housing head portion and the resilient bumper 54*a* carried by the reciprocator assembly, tool 200 has additional resilient means which prevents rigid collisions between and among the housing, the fastener driving means (i.e., piston 74*a* and striking rod 76*a*), and the dimpler means 78*a* upon firing of the tool. These additional resilient means include annular bumpers 260 and 262.

Annular bumper 260 encircles and slidably receives fastener striking rod 76*a* and is positioned at the upper end of dimpler shaft 236 by means of mounting member 264. Mounting member 264 has an axially extending opening 266 through which fastener striking rod 76*a* extends and a downwardly extending, externally threaded boss 268 which is threaded into an enlarged upper end portion 270 of axially extending dimpler passage 164*a*. Mounting member 264 has a circular horizontally extending base flange 272 which projects radially outwardly of the upper end of the dimpler shaft around its perimeter. Extending upwardly from the perimeter of base flange 272 is support flange 274 which forms an annular channel with base flange 272 in which bumper 260 is received and supported. For reasons described below, a circumferentially spaced series of axially extending openings 276 are formed through bumper 260. As will be seen, bumper 260 functions to prevent rigid contact between piston 74*a* and dimpler shaft 236, while bumper 54*a*, positioned below the base flange 72, functions, in part, to prevent rigid impact between mounting member 264 and housing flange 234.

Annular resilient bumper 262 also circumscribes dimpler shaft 236 and is interposed between dimpler flange 242 and interior housing shoulder 244 below it. It should be noted that the dimpler flange in tool 200, which is used to control the depth of the drywall dimple, has been relocated from adjacent the lower end of the dimpler shaft to the intermediate longitudinal position indicated in FIG. 15. It will be seen that annular bumper 262 prevents the rigid impact between flange 242 and the housing which was present between flange 82 and the housing in the previously described tool.

At this point, another modification of the tool's bumper system should be noted. In tool 200, upturned stop or flange 56 (FIG. 1), whose upper end was positioned just below the upper surface of bumper 54, has been eliminated and bumper 54 (54*a* in FIG. 15) has been radially inwardly thickened and somewhat shortened. As will be seen, this elimination of flange 56 eliminates the rigid stopping surface which was presented when bumper 54 was slightly downwardly deflected.

By means of the fastener feeding system (not shown in FIG. 15), drywall nail 58*a* is fed into axial dimpler shaft passage 164*a* through a slot (also not shown in FIG. 15) in the dimpler shaft. Such slot is transversely widened to accept the head of the nail. To strengthen the dimpler shaft in the vicinity of this widened slot area, circumferential enlargement 278 is formed on the dimpler shaft. To prevent the dimpler shaft from rotating about its longitudinal axis (which would rotate the nail receiving slot out of its necessary nail receiving position), metal washer 280, which circumscribes the dimpler shaft just above lower dimpler flange 246, is interposed between dimpler cap 32*a* and the lower end of housing nose portion 204 through which the dimpler cap is secured. Washer 280 has an upturned lug 282 which is received in a corresponding slot in housing nose portion 204 to prevent relative rotation between washer 280 and nose portion 204. Downturned lug 284 is slidably received in a peripheral notch formed in lower dimpler flange 246 to prevent rotation of the dimpler shaft relative to nose portion 204. As an alternative, the dimpler shaft may be square or of another non-cylindrical configuration.

In tool 200, the housing head portion and the reciprocator body are not tapered inwardly to provide the structural means for positioning and guiding the tool against a corner wall of a room to properly drive fasteners and form dimples at such corner. Instead of such tapering of the housing and reciprocator, such structural means in tool 200 comprise an enlarged lower side portion 285 of the housing head portion which has a downwardly and inwardly sloping wall contacting face 287 which faces away from handle 26a. It is this face which is positioned against a corner wall to properly position the tool to drive fasteners into and dimple the drywall sheet extending perpendicularly to the guiding wall.

As illustrated in FIGS. 19 and 20, a typical actuation means of tool 200 will include generally cylindrically shaped first and second pneumatic valves 286 and 288, received, respectively, in cylindrical openings 290 and 292 formed in the underside of handle 26a adjacent housing head portion 202.

Valve 286 has an upper end inlet 294, which communicates with handle reservoir chamber 28a via passage 296 formed in the handle, a first sidewall port 298, which communicates with an air tube portion 300 of control passageway 36a through handle passage 302, and a second sidewall port 304. Port 298 is offset upwardly of port 304 and is separated therefrom by a valve seat having central axial opening 306. Positioned above the valve seat is internal valve chamber 308 which opens outwardly through inlet 296 and side port 298. Side port 304 communicates with chamber 308 through valve seat opening 306. Control means for valve 286 include manually operable plunger 310, slidably received within the valve, and ball 312 positioned within chamber 308.

Valve 288 has an upper end portion 314 which is transversely reduced relative to handle opening 292 and is positioned slightly below its upper end, thereby defining air passageway 316 which envelopes upper valve end 314. Internal chamber 318 in valve 288 opens outwardly through an upper end valve inlet 320 and a side outlet valve port 322. Interposed between valve inlet 320 and valve outlet 322 is a valve seat having central opening 324 formed therethrough. Side outlet port 322 communicates with the atmosphere through vent passage 326 formed in handle 26a. Control means for valve 288 includes plunger 328 slidably received within valve 288 and ball 330 within chamber 318, ball 330 being biased into the valve seat opening by compression spring 332 within chamber 318.

The lower end of plunger 328 has a slot in it which receives the upper end of safety interlock member or probe 88a. The upper probe end is retained in such slot by suitable means such as pin 332. The lower or forward end 334 of the probe (FIG. 15) is slidably received in a slot formed through the lower flanged end of housing nose portion 204 and dimpler cap 32a (see FIG. 19) and projects forwardly of the dimpler cap as shown in FIG. 15. It should be noted that probe 80a, unlike probe 88 of the previously described tool, is not interconnected to dimpler shaft 236, but functions independently of it. Thus, as dimpler cap 32a is pressed into engagement with a workpiece, the probe is pushed upwardly thereby depressing plunger 328 of valve 288. Valve spring 332 in valve 288 biases ball 330 downwardly into engagement with the upper end of plunger 328, which in turn biases the probe to its forward-most position, as indicated in FIG. 15.

The valves 286 and 288 are pneumatically connected in series by means of air passage 336 formed in handle 26a and communicating side port 304 of valve 286 with inlet opening 320 of valve 288 via air passage 316 which envelopes upper end portion 314 of valve 288. As described below, the series interconnection of valves 286 and 288 requires that both plungers 310 and 328 be depressed in order to vent poppet valve control chamber 66a (FIG. 15) to actuate tool 200. As will be appreciated, other known actuation means may be substituted for the described means.

Because of factors including the locations and constructions of the described bumpers or pads, tool 200 has a life surprisingly and dramatically greater than that of the previous embodiment.

METHOD OF OPERATION

FIGS. 15 through 18 depict in sequence four positions of the components of tool 200 during a single firing and reset cycle thereof. Before describing the operation of the improved and currently preferred tool 200, it should be noted that it has recoil delaying and reducing characteristics at least equal to those of the previously described tool. More specifically, the reciprocator assembly and fastener-driving means of tool 200 cooperate during and subsequent to the actual driving of fastener 58a to substantially eliminate rearward recoil of the housing, i.e., the recoil sensible by an operator of the tool, during the forward driving stroke of piston 74a and minimize housing recoil subsequent to such driving stroke.

Referring first to FIG. 15 in which the components of tool 200 are in their ready-to-fire positions, high pressure air fills reservoir chamber 28a, surge chamber 62a, and interconnecting internal passage 212. This high pressure air is communicated to poppet valve control chamber 66a and annular chamber 64a circumscribing the upper end portion 102a of the reciprocator through passageway system 36a. Supply tube portion 300 of passageway system 36a receives high pressure air from reservoir chamber 28a which enters inlet 294 of valve 286 and forces ball 312 (FIG. 20) downwardly into valve seat opening 306. The air exits valve side port 298 and enters supply tube 300 via handle passage 302. The high pressure air in poppet valve control chamber 66a, coupled with the biasing force of poppet valve spring 106a, forces the poppet valve downwardly into its sealing position against upper end 222 of internal reciprocator cylinder 52a.

Although the high pressure air in surge chamber 62a exerts an upward force upon a small peripheral area of poppet valve 57a, it can be seen that the horizontal valve area upon which this pressure force acts is considerably less than the horizontal valve body area upon which the high pressure air in control chamber 66a exerts a downward force. This larger downward force, coupled with the downward spring force on the poppet valve, holds the valve in its cylinder-sealing position. The axially extending poppet valve opening 250 is vented to atmosphere via relief chamber 108a, vents 329 formed in the upper end of reciprocator body 220, and upper housing outlet ports 190a. Air at atmospheric pressure is present within internal reciprocator cylinder 52a and compression chamber 40a surrounding it. The interior of cylinder 52a communicates with compression chamber 40a through small cylinder ports 98a and larger cylinder ports 99a below them which are formed through the cylinder wall.

Figure 16:
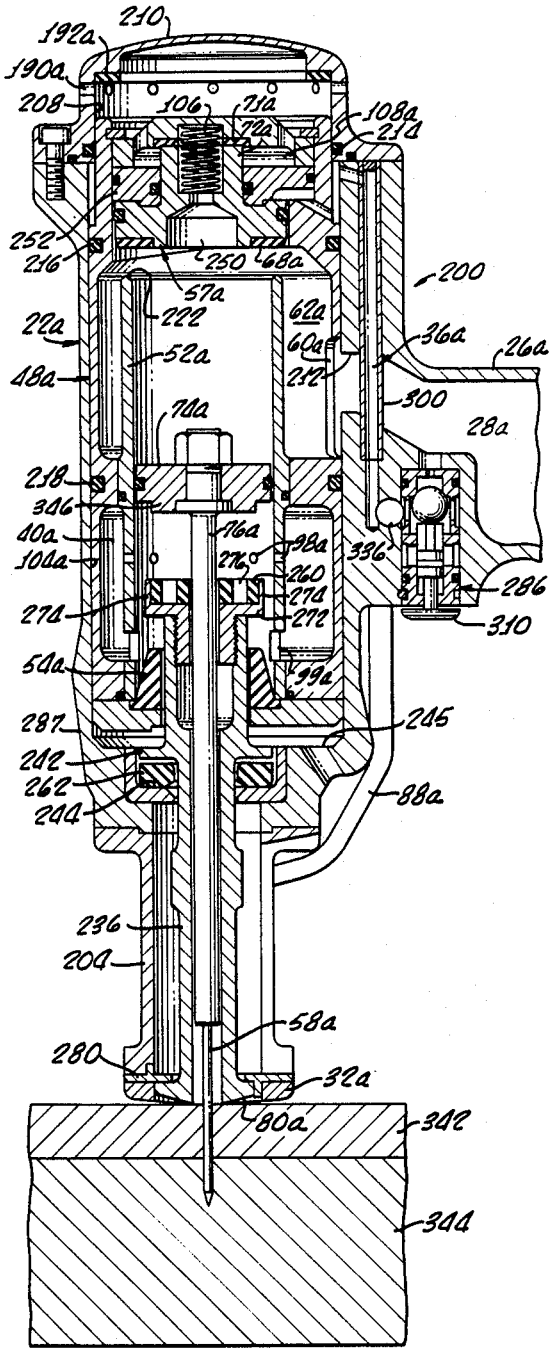
FIG. 16 is a reduced scale cross-sectional view through the tool during driving of a fastener into a drywall sheet and underlying framing stud.

FIG. 16 depicts the positions of the tool components just subsequent to firing in which dimpler nose 32a has been pressed against outer surface 340 of drywall sheet 342 and has thus forced the drywall sheet into firm abutment with one of its underlying framing studs 344. This pressing of the dimpler nose against the outer drywall surface forces forward probe end 334 (FIG. 15) rearwardly thereby depressing plunger 328 of safety valve 288. Additionally, plunger 310 of valve 286 has been manually depressed. With both of the plungers depressed (as indicated by the dashed arrow on the plungers in FIG. 20), ball 312 is pushed upwardly by plunger 310 and seals valve inlet 294, while ball 330 is pushed upwardly thereby unblocking valve seat opening 324.

Air in passageway system 36a is then vented through air tube 300 into chamber 302 and subsequently vented through handle vent opening 326 via valve port 298, valve port 304, interconnecting passageway 336, and outlet port 322, all as indicated by dashed arrows in FIG. 20.

This venting of passageway system 36a rapidly reduces the pressure in poppet valve control chamber **66*a* which allows the high pressure air in surge chamber 62*a* (FIG. 16) to thrust poppet valve 57*a* upwardly against internal flange 252 against the resistance of compression spring 106*a*. When the poppet valve reaches this upper position, the upper end of valve boss 72*a* seals against sealing ring 71*a* carried by the upper end of the reciprocator body. This sealing precludes upward passage of air through poppet valve opening 250 into relief chamber 108*a***.

The upward movement of the poppet valve unseats seal **68*a* from upper end 222 of internal reciprocator cylinder 52*a* which allows the high pressure air in surge chamber 62*a* to very rapidly enter cylinder 52*a* and thrust piston 74*a*** downwardly through its driving stroke.

The entrance of surge chamber air into cylinder **52*a* simultaneously causes reciprocator assembly 48*a* to reactively recoil upwardly in chamber 104*a* away from its ready-to-fire position against bottom end 245 of chamber 104*a*. The mass of reciprocator assembly 48*a* is many times that of the combined masses of piston 74*a* and fastener striking rod 76*a*. In one embodiment, the ratio is approximately 14:1. Therefore, the initial downward acceleration of the piston is greater than that of the initial upward acceleration of the reciprocator assembly. Thus, as indicated in FIG. 16**, just subsequent to firing, the downward travel of the piston is significantly larger than the reactive upward travel of the reciprocator assembly.

It is an important aspect of the present invention that during the driving stroke of piston **74*a*, no appreciable rearward recoil of the housing occurs. Thus, during the driving stroke, dimpler nose 32*a* may be handheld in firm engagement with outer surface 340 of drywall sheet 342, as indicated in FIG. 16**.

This very desirable feature of tool 200, as in the previously described tool, is obtained by a unique cooperation between the reciprocator assembly and the piston during the driving stroke. More specifically, during the piston's driving stroke, the reciprocator assembly functions as a movable firing base from which the piston is thrust. The reactive recoil energy of the downwardly moving piston is transmitted not to the housing, but substantially entirely to the reciprocator assembly. The upwardly moving reciprocator slides along the inner surface of recoil chamber **104*a* on its low friction seals 214, 216, and 218. This smooth sliding of the reciprocator is further enhanced in tool 200 by anodizing the inner surface of chamber 104*a*. If the materials are such that the sliding is along plastic instead of metal, a surface treatment of molybdenum dry lube may be used. Because of the plurality of outlet ports 190*a* formed through the upper end of the housing head portion, the upwardly moving reciprocator assembly forces air above it in chamber 104*a*** to atmosphere without causing a pneumatic impact upon the housing. Thus, during the piston's driving stroke, the reciprocator and the piston cooperate to prevent sensible tool recoil during the driving stroke.

As piston **74*a* is driven downwardly by the high pressure surge chamber air, the cylinder air in front of the piston is compressed and driven outwardly through cylinder ports 98*a* and 99*a*, in turn pressurizing the air in the compression chamber 40*a*. This pressurized air in the compression chamber may be used to operate the fastener feeding means, as previously described, and may also be used to return piston 74*a*** to its ready-to-fire position, as described below.

Figure 17:
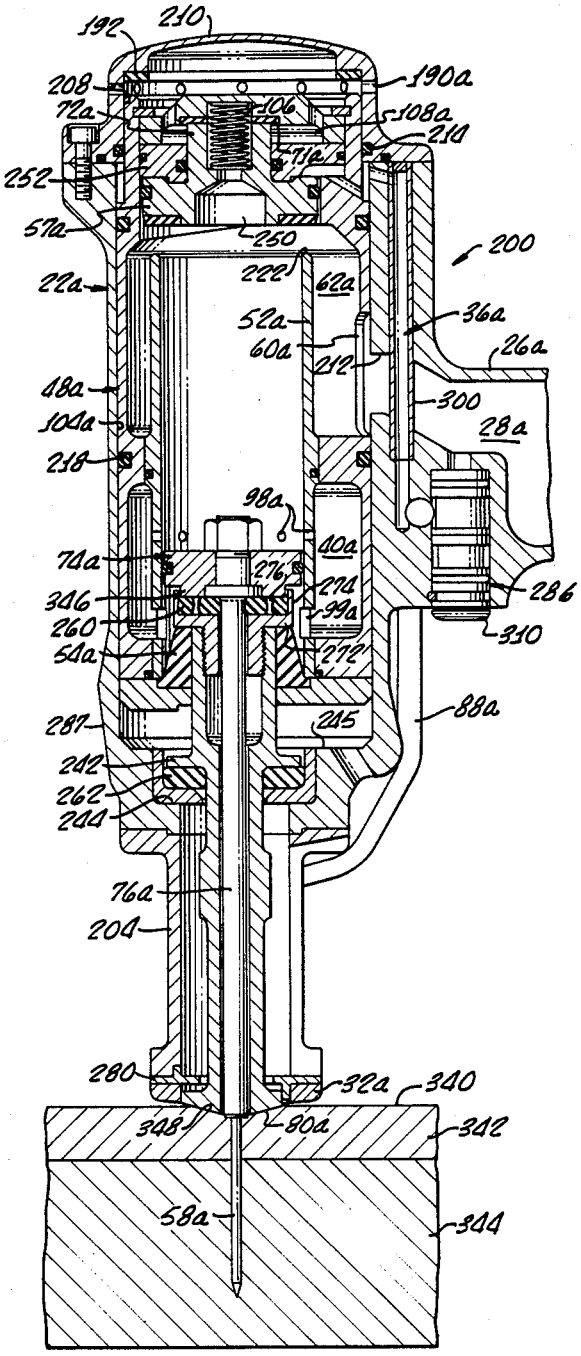
FIG. 17 is a view similar to FIG. 16 showing the tool's components at the completion of the fastener-driving stroke of the piston.

As piston **74*a* continues its downward travel and acceleration, fastener striking rod 76*a* next strikes the head of nail 58*a* and begins to drive it into drywall sheet 342 and underlying framing stud 344, as illustrated in FIG. 16. While rod 76*a* is driving the nail into the drywall, a downwardly projecting, reduced diameter cylindrical portion 346 of piston 74*a*, which has a diameter slightly less than the inner diameter of upturned dimpler flange 274, strikes upper dimpler bumper 260, driving dimpler shaft 236 downward. This in turn forces work engaging surface 80*a* of the dimpler shaft into the drywall to form drywall surface dimple 348 (FIG. 17) as the nail is being recessed by rod 76*a* at the end of the piston's driving stroke. Upper bumper 260 is axially compressed by piston portion 346 and the bumper material is forced horizontally into circumferentially spaced openings 276, as indicated in FIG. 17. Intermediate dimpler flange 242 is driven downwardly against and compresses bumper 262 which prevents rigid contact between flange 242 and the housing, the piston not quite striking the upper end of upturned dimpler flange 274. Bumper 262** additionally functions to control the depth of the dimple; the thicker the bumper, the shallower the dimple, and vice versa.

The impact between the downwardly facing central piston portion 346 and dimpler bumper 260 occurs at the very end portion of the piston's fastener-driving stroke. At or very shortly after the simultaneous completion of the fastener-driving and the dimpling strokes, at which time the piston and the dimpler shaft are essentially stationary having driven and recessed the nail and formed the dimple, the still upwardly traveling reciprocator bumper or energy absorbing means **54*a* strikes the underside of the horizontally extending dimpler flange 272. Bumper 54*a* is compressed and slightly retracts both the dimpler shaft and the piston as the reciprocator assembly continues to move upwardly. The collision between bumper 54*a* and flange 272 is entirely resilient due to the absence of upturned flange 56 (FIG. 1**).

When bumper **54*a* strikes dimpler flange 272, it pneumatically seals the reciprocator assembly causing it to become, in effect, a closed vessel so that high pressure air in reservoir chamber 28*a* communicating with surge chamber 62*a*** no longer exerts a propelling force on the reciprocator assembly. Thus, at this point, no further recoil energy is added to the reciprocator assembly.

The collision between reciprocator assembly **48*a* and striking rod 76*a* and piston 74*a*, which transfers a portion of the reciprocator's kinetic or recoil energy to bumper 54*a*, aids in stopping the upward travel of the reciprocator within chamber 104*a*. The balance of the reciprocator's kinetic energy is frictionally transferred to the housing without impact therewith and the recoil of the housing subsequent to the fastener driving and dimpling strokes is thus significantly reduced. Stated otherwise, the final stopping of the upwardly moving reciprocator is accomplished before it strikes upper housing bumper 192***a*. Thus, the recoil energy arising from the driving of piston 74*a* is both received and controlled by the reciprocator assembly, which cooperates with piston 74*a* to preclude appreciable recoil of the housing during the piston's driving stroke and to subsequently smoothly dissipate the recoil energy in the reciprocator assembly without impingement between the reciprocator and the housing, thus minimizing subsequent housing recoil.

As indicated in FIG. 18, to reset tool 200, plunger 310 is released. When this is done, high pressure air in reservoir chamber 28*a* forces ball 312 downwardly into sealing engagement with valve seat opening 306 and allows the air in chamber 28*a* to flow into valve inlet 294, through side valve port 298, and upwardly through supply tube 300. This air then forces its way into annular chamber 64*a* and thence into poppet valve control chamber 66*a*.

The high pressure air in annular chamber 64*a* operates upon the upwardly facing reciprocator ledge 320 to return the reciprocator assembly downwardly toward its ready-to-fire position as indicated in FIG. 15. The high pressure air entering poppet valve control chamber 66*a* also drives poppet valve 57*a* downwardly into sealing engagement with upper end 222 of internal cylinder 52*a*. This in turn vents the high pressure air within the cylinder through poppet valve opening 238, relief chamber 108*a*, and upper outlet ports 190*a* in the housing. The pressurized air in the compression chamber 40*a* then flows through lower cylinder ports 99*a* and exerts an upward force on the underside of piston 74*a* to move it upwardly toward its ready-to-fire position (as indicated in FIG. 18) against the underside of the poppet valve.

The foregoing detailed description is to be clearly understood as given by way of illustration and example only, the spirit and scope of this invention being limited solely by the appended claims.

What is claimed is:

1. A fastener driving tool comprising:

(a) a housing;

(b) a reciprocator assembly mounted for linear movement within said housing;

(c) means for pneumatically driving fasteners in a single strokes into a workpiece, at least a portion of said fastener driving means being mounted within said reciprocator assembly for parallel linear movement relative thereto;

(d) means for pneumatically actuating said fastener driving means forwardly through a driving stroke and simultaneously reactively actuating said reciprocator assembly rearwardly within said housing whereby rearward recoil of said housing during said driving stroke is substantially eliminated;

(e) means carried by said reciprocator assembly for cooperating with said fastener driving means by impingement therewith to dissipate recoil energy of said reciprocator assembly with but slight impingement of said reciprocator assembly upon said housing, whereby rearward recoil of said housing subsequent to said driving stroke is significantly reduced; and (f) dimpler means for forming a rounded dimple in a workpeice as the fastener is being driven thereinto, said dimple circumscribing the driven fastener wherein said dimpler means include an elongated dimpler member carried by said housing for a limited longitudinal movement parallel to said linear movement of said reciprocator assembly, said dimple member having an inner end positioned to be struck by said fastener driving means during said driving stroke, and a tapered outer end positioned to be driven into a workpiece to form said dimple, said outer end of said dimpler member having a work piece engaging surface having two areas making two respectively distinctly different angles with the axis of movement of said dimple member, whereby uniform dimples may be formed despite tilting of said tool and the axis of movement of said fastener driving means relative to the surface of a workpiece in which a dimple is to be formed.

2. The tool of claim 1 including resilient means for preventing rigid collision between said fastener driving means, said dimpler means, said reciprocator assembly, and said housing upon actuation of said tool, and wherein said portion of said fastener driving means includes a piston, said means (e) comprises a bumper positioned adjacent the forward end of said reciprocator assembly, said inner end of said dimpler member is positioned between said bumper and said piston, said dimpler member has a transverse external flange positioned forwardly of said bumper, and said housing has an internal shoulder circumscribing and being positioned forwardly of said flange, and wherein said resilient means include said bumper and further comprises:

(a) a first resilient member mounted on said inner end of said dimpler member; and (b) a second resilient member interposed between said flange and said internal shoulder.

3. The tool of claim 2 wherein said resilient means further include a third resilient member carried by said housing and positioned rearwardly of and in the path of said reciprocator assembly.

4. A fastener driving tool comprising:

(a) an outer housing;

(b) a reciprocator assembly mounted for linear movement within said housing, said reciprocator assembly containing an inner cylinder;

(c) means, including a fastener driving piston mounted for linear movement within said inner reciprocator cylinder, for pneumatically driving fasteners into objects to be secured together;

(d) means for simultaneously actuating said fastener driving piston in one direction through a driving stroke and said reciprocator assembly in an opposite direction, whereby fasteners are driven without significant recoil being transmitted to said housing during said driving stroke;

(e) means for mounting said driving piston for linear movement along an axis which is parallel to but substantially displaces in one direction from the axis of movement of said reciprocator assembly;

(f) means secured to said reciprocator assembly for engaging said piston subsequent to said driving stroke to aid in stopping the oppositely moving reciprocator assembly;

(g) dimpler means for providing a rounded surface dimple in one of the objects around a fastener as the fastener is driven; and (h) structural means for guiding and locating said tool to drive fasteners into the wall of a room within one inch of the corner of a room, with the fasteners being angled toward the corner of the room, said structural means including a tapering of the housing toward the driving end of the tool to provide a close approach and a slight angling of the driving axis of the tool toward the corner of a room.

5. The tool of claim 4 wherein said dimpler means are provided with a tapered work engaging head having a face having two areas making two respectively distinctly different angles with the axis of movement of said dimpler means, whereby uniform dimples may be made despite tilting of the tool and the axis of said piston relative to the surface of a workpiece into which the fasteners are to be driven.

6. The tool of claim 5 wherein the angle of tapering of said housing relative to the axis of said drive piston is substantially equal to the difference in said angles of said two areas on said face of said work engaging head of said dimpler means.

7. The tool of claim 4 further comprising surge reservoir means for applying vigorous initial acceleration to said driving piston when it is initially actuated, and additional reservoir means for providing a source of high pressure air to restore said driving piston to its original position following completion of a stroke.

8. A fastener-driving tool comprising:

(a) an outer housing;

(b) a unitary reciprocator assembly mounted for forward and rearward linear movement within said housing, said reciprocator assembly containing an inner cylinder;

(c) means, including a fastener driving piston member mounted for linear movement within said inner reciprocator cylinder, for pneumatically driving fasteners into material to be secured together;

(d) means for simultaneously pneumatically actuating said piston member in one director for driving a fastener and for actuating said reciprocator assembly in the other direction, with a substantially equal amount of momentum, to greatly reduce transmission of recoil to said housing;

(e) dimpler means for providing a rounded dimple in the surface around the fastener as the fastener is driven, said dimpler means being mounted substantially symmetrically with respect to the axis of said fastener driving means, and having a front work engaging end;

(f) means for positioning said dimpler means for engagement by said piston member and for limited movement coaxially with said piston member;

(g) retracted dimpler stop means;

(h) forward dimpler depth controlling stop means;

(i) means for normally biasing said dimpler into engagement with the forward stop means; and (j) means for enabling action of the fastener tool only when said dimpler is pressed against the work to force the dimpler into engagement with the retracted stop means.

9. A fastener-driving tool comprising:

(a) an outer housing;

(b) a unitary reciprocator assembly mounted for forward and rearward linear movement within said housing, said reciprocator assembly containing an inner cylinder;

(c) means, including a fastener driving piston member mounted for linear movement within said inner reciprocator cylinder, for pneumatically driving fasteners into material to be secured together;

(d) means for simultaneously pneumatically actuating said piston member in one direction for driving a fastener and for actuating said reciprocator assembly in the other direction, with a substantially equal amount of momentum, to greatly reduce transmission of recoil to said housing;

(e) dimpler means for providing a rounded dimple in the surface around the fastener as the fastener is driven, said dimpler means being mounted substantially symmetrically with respect to the axis of said fastener driving means, and having a front work engaging end;

(f) means for positioning said dimpler means for engagement by said piston member and for limited linear movement coaxially with said piston member;

(g) a retainer cap on the front of said tool housing and enclosing the front work engaging end of said dimpler means; and (h) mounting means for said dimpler permitting said dimpler to slide back into said retainer cap prior to initiating operation of said tool.

10. A fastener-driving tool comprising:

(a) an outer housing;

(b) a unitary reciprocator assembly mounted for linear movement within said housing, said reciprocator assembly containing an inner cylinder;

(c) means, including a fastener driving piston mounted for linear movement within said inner reciprocator cylinder, for pneumatically driving fasteners into material to be secured together;

(d) means for simultaneously pneumatically actuating said driving piston in one direction for driving a fastener and for actuating said reciprocator assembly in an opposite direction, with a substantially equal amount of momentum, to substantially eliminate transmission of recoil to said housing during movement of said piston;

(e) dimpler means for providing a rounded dimple in a workpiece surface around the fastener as the fastener is driven, said dimpler means being mounted substantially symmetrically with respect to the axis of said fastener driving means;

(f) means for mounting said dimpler means for engagement by said driving piston and for limited linear movement coaxially with said fastener driving piston; and (g) dimpler means having a curved wall engaging head with a face having two areas making two respectively distinctly different angles with the axis of movement of said dimpler means, whereby uniform dimples may be made despite tilting of the tool and the axis of said driving piston relative to the surface of the work into which the fasteners are to be driven.

11. The tool of claim 10 wherein two angles are approximately 75° in one direction and 70° in the other direction.

12. The tool of claim 10 wherein said two angles are approximately three to seven degrees different, and wherein the greater of the two angles is equal to between about 79° and 83°.

13. A fastener driving and dimpling apparatus adapted to drive a fastener and make a dimple therearound in the absence of metal-to-metal impacts between any parts of the apparatus, said apparatus comprising:

(a) an outer housing;

(b) piston means mounted in said housing, said piston means being adapted to engage a fastener and drive it into a workpiece;

(c) fluid-operated means to actuate said piston means in such manner as to drive said fastener fully into the workpiece in a single stroke;

(d) dimpler means having an inner end, and also having an outer end adapted to contact and dimple the workpiece;

(e) first resilient bumper means provided at said inner end and adapted to be engaged by said piston means so that said dimpler means is actuated; and (f) second resilient bumper means disposed outwardly of an intermediate portion of said dimpler means and inwardly of a portion of said housing.

14. The invention as claimed in claim 13 in which when in its position assumed, prior to actuation of said piston means toward the workpiece, said intermediate portion of said dimpler means is spaced a small distance inwardly of said second bumper means.

15. The invention as claimed in claim 14 in which said first and second bumper means are elastomeric, and said intermediate portion of said dimpler means is a flange on an outwardly extending fastener striking portion of said piston means.

16. The invention as claimed in claim 13 in which said inner end of said dimpler means is cup shaped, and said first resilient bumper means is an elastomeric cushion disposed therein and adapted to be engaged over a large area by a portion of said piston means.

17. The invention as claimed in claim 16 in which said cushion is plural-appertured to increase its resilience.

18. A fastener driving tool comprising:

(a) a housing;

(b) a reciprocator assembly mounted for linear movement within said housing;

(c) means for pneumatically driving fasteners into a workpiece, at least a portion of said fastener driving means being mounted within said reciprocator assembly for parallel linear movement relative thereto;

(d) means for pneumatically actuating said fastener driving means forwardly through a driving stroke and simultaneously reactively actuating said reciprocator assembly rearwardly within said housing, whereby rearward recoil of said housing during said driving stroke is substantially eliminated;

(e) means carried by said reciprocator assembly for cooperating with said fastener driving means by impingement therewith to disipate recoil energy of said reciprocator assembly with but slight impingment of said reciprocator assembly upon said housing, whereby rearward recoil of said housing subsequent to said driving stroke is significantly reduced; and (f) dimpler means for forming a rounded dimple in a workpiece as a fastener is being driven thereinto, said dimple circumscribing the driven fastener, wherein said dimpler means include an elongated dimpler member carried by said housing for limited longitudinal movement parallel to said linear movement of said reciprocator assembly, said dimpler member having an inner end positioned to be struck by said fastener driving means during said driving stroke, and a tapered outer end positioned to be driven into a workpiece to form said dimple wherein said outer end of said dimpler member has a workpiece engaging surface having two areas making two respectively distinctly different angles with the axis of movement of said dimpler member, whereby uniform dimples may be formed despite tilting of said tool and the axis of movement of said fastener driving means relative to the surface of a workpiece in which a dimple is to be formed.

19. A fastener driving tool comprising:

(a) a housing;

(b) a reciprocator assembly mounted for linear movement within said housing;

(c) means for pneumatically driving fasteners into a workpiece, at least a portion of said fastener driving means being mounted within said reciprocator assembly for parallel linear movement relative thereto;

(d) means for pneumatically actuating said fastener driving means forwardly through a driving stroke and simultaneously reactively actuating said reciprocator assembly rearwardly within said housing, whereby rearward recoil of said housing during said driving stroke is substantially eliminated;

(e) means carried by said reciprocator assembly for cooperating with said fastener driving means by impingement therewith to dissipate recoil energy of said reciprocator assembly with but slight impingement of said reciprocator assembly upon said housing, whereby rearward recoil of said housing subsequent to said driving stroke is significantly reduced;

(f) dimpler means for forming a rounded dimple in a workpiece as a fastener is being driven thereinto, said dimple circumscribing the driven fastener, wherein said dimpler means include an elongated dimpler member carried by said housing for limited longitudinal movement parallel to said linear movement of said reciprocator assembly, said dimpler member having an inner end positioned to be struck by said fastener driving means during said driving stroke, and a tapered outer end positioned to be driven into a workpiece to form said dimple; and (g) resilient means for preventing rigid collision between said fastener driving means, said dimpler means, said reciprocator assembly, and said housing upon actuation of said tool wherein said resilient means comprises a bumper positioned adjacent the forward end of said reciprocator assembly, said inner end of said dimpler member is positioned between said bumper and said piston, said dimpler member has a transverse external flange positioned forwardly of said bumper, and said housing has an internal shoulder circumscribing and being positioned forwardly of said flange, and wherein said resilient means include said bumper and further comprise:

(1) a first resilient member mounted on said inner end of said dimpler member; and (2) a second resilient member interposed between said flange and said internal shoulder.

20. The tool of claim 19 wherein said resilient means further include a third resilient member carried by said housing and positioned rearwardly of and in the path of said reciprocator assembly.

21. A fastener-driving tool comprising:

(a) an outer housing;

(b) a unitary reciprocator assembly mounted for forward and rearward linear movement within said housing, said reciprocator assembly containing an inner cylinder;

(c) means, including a fastener driving piston member mounted for linear movement within said inner reciprocator cylinder, for pneumatically driving fasteners into material to be secured together;

(d) means for simultaneously pneumatically actuating said piston member in one direction for driving a fastener and for actuating said reciprocator assembly in the other direction, with a substantially equal amount of momentum, to greatly reduce transmission of recoil to said housing;

(e) dimpler means for providing a rounded dimple in the surface around the fastener as the fastener is driven, said dimpler means being mounted substantially symmetrically with respect to the axis of said fastener driving means, and having a front work engaging end;

(f) means for positioned said dimpler means for engagement by said piston member and for limited linear movement coaxially with said piston member;

(g) retracted dimpler stop means;

(h) forward dimpler depth controlling stop means;

(i) means for normally biasing said dimpler into engagement with the forward stop means; and (j) means for enabling action of the fastener tool only when said dimpler is pressed against the work to force the dimpler into engagement with the retracted stop means.

22. A fastener-driving tool comprising:

(a) an outer housing;

(b) a unitary reciprocator assembly mounted for forward and rearward linear movement within said housing, said reciprocator assembly containing an inner cylinder;

(c) means, including a fastener driving piston member mounted for linear movement within said inner reciprocator cylinder, for pneumatically driving fasteners into material to be secured together;

(d) means for simultaneously pneumatically actuating said piston member in one direction for driving a fastener and for actuating said reciprocator assembly in the other direction, with a substantially equal amount of momentum, to greatly reduce transmission of recoil to said housing;

(e) dimpler means for providing a rounded dimple in the surface around the fastener as the fastener is driven, said dimpler means being mounted substantially symmetrically with respect to the axis of said fastener driving means, and having a front work engaging end;

(f) means for positioning said dimpler means for enagagement by said piston member and for limited linear movement coaxially with said piston member;

(g) a retainer cap on the front of said tool housing and enclosing the front work engaging end of said dimpler means; and (h) mounting means for said dimpler permitting said dimpler to slide back into said retainer cap prior to initiating operation of said tool.

* * * * *